US005558797A

United States Patent [19]

Takagi

[11] Patent Number: 5,558,797

[45] Date of Patent: Sep. 24, 1996

[54] AUTOMATIC FOOD TYPE DETERMINING DEVICE FOR A HEATING APPARATUS

[75] Inventor: Minoru Takagi, Aichi-ken, Japan

[73] Assignee: Kabushiki Kaisha Toshiba, Japan

[21] Appl. No.: 143,851

[22] Filed: Oct. 25, 1993

[30] Foreign Application Priority Data

Oct. 26, 1992 [JP] Japan ..... 4-287281

[51] Int. Cl.[6] ..... H05B 6/68

[52] U.S. Cl. ..... 219/705; 219/707; 219/710; 99/325

[58] Field of Search ..... 219/707, 704, 219/705, 710, 711, 712; 99/DIG. 14, 451, 325

[56] References Cited

U.S. PATENT DOCUMENTS

| | | | |
|---|---|---|---|
| 4,324,966 | 4/1982 | Tanabe | 219/705 |
| 4,376,131 | 3/1983 | Mori et al. | 219/707 |
| 4,379,964 | 4/1983 | Kanazawa et al. | 219/707 |
| 4,463,238 | 7/1984 | Tanabe | 219/10.55 |
| 4,481,394 | 11/1984 | Tanabe | 219/705 |
| 4,484,065 | 11/1984 | Ueda | 219/492 |
| 4,692,597 | 9/1987 | Tsuda et al. | 219/492 |
| 4,874,928 | 10/1989 | Kasai | 219/705 |

FOREIGN PATENT DOCUMENTS

| | | | |
|---|---|---|---|
| 0053523 | 6/1982 | European Pat. Off. | H05B 6/68 |
| 0093173 | 11/1983 | European Pat. Off. | H05B 6/68 |
| 576145 | 12/1993 | European Pat. Off. | F24C 7/08 |
| 2081476 | 2/1982 | United Kingdom | H05B 6/68 |

*Primary Examiner*—Philip H. Leung
*Attorney, Agent, or Firm*—Limbach & Limbach L.L.P.

[57] ABSTRACT

A heating apparatus such as microwave ovens includes a heating chamber having a door, heaters for heating food contained in the heating chamber, a temperature sensor for sensing a temperature in the heating chamber to provide an output in accordance with the sensed temperature, a gas sensor sensing a volume of gas in the heating chamber to provide an output in accordance with the sensed gas volume, and a microcomputer-based control device. The control device sets a reference value in accordance with the output of the temperature sensor, the reference value being for determining the kind of the food. The control device further calculates a change rate of the gas volume on the basis of the output of the gas sensor. The control device then compares the change rate of the gas volume with the reference value to determine the kind of the food contained in the heating chamber.

11 Claims, 6 Drawing Sheets

| TYPE | | Ta | α (%) 5 10 |
|---|---|---|---|
| ALCOHOL NOT CONTAINED | CREAM PUFF | 25℃ | 1.3 |
| ALCOHOL NOT CONTAINED | ROAST BEEF | 25℃ | 1 |
| ALCOHOL NOT CONTAINED | CAKE ROOL | 25℃ | 0.5 |
| ALCOHOL NOT CONTAINED | RISOTTO | 25℃ | 0.5 |
| ALCOHOL NOT CONTAINED | MADELEINE | 25℃ | 0.9 |
| ALCOHOL NOT CONTAINED | ROAST CHICKEN | 25℃ | 0.5 |
| ALCOHOL NOT CONTAINED | SPONGE CAKE | 25℃ | 0 |

FIG. 5 (a)

| TYPE | | Ta | α (%) 5 10 20 30 40 50 60 |
|---|---|---|---|
| ALCOHOL CONTAINED | BROILED PORK | 25℃ | 13.1 |
| ALCOHOL CONTAINED | POUND CAKE | 25℃ | 46.4 |
| ALCOHOL CONTAINED | BUTTERED ROLL | 25℃ | 45.9 |
| ALCOHOL CONTAINED | APPLE PIE | 25℃ | 29.5 |

FIG. 5 (b)

AUTOMATIC FOOD TYPE DETERMINING DEVICE FOR A HEATING APPARATUS

BACKGROUND OF THE INVENTION

1. Field of the Invention

This invention relates to a heating apparatus such as microwave ovens wherein the type of food contained in a heating chamber is determined on the basis of a change rate of volume of gas emanated from the food in the heating chamber.

2. Description of the Prior Art

Heating apparatus such as microwave ovens have recently been provided with a gas sensor for sensing gas emanated from food to be cooked so that the type of the food is determined on the basis of an output of the gas sensor and the heating operation is controlled in accordance with the result of determination. More specifically, the employed gas sensor is particularly sensitive to a volatile high polymer gas. A change rate of an output of the gas sensor or a change rate of gas volume is calculated by a control circuit. The obtained change rate of the gas volume is compared with a previously set reference value. On the basis of the result of comparison, it is determined whether the type of the food to be heated is one containing a large volume of gas or not.

However, an initial temperature in the heating chamber takes different values, for example, when the heating operation is performed a relatively long period of time after the last operation and when the heating operation is repeated at one time. Furthermore, a generation rate of the gaseous alcohol varies depending upon the initial temperature in the heating chamber. In view of these facts, the type of the food determined in the manner as described above sometimes differs from an actual type of the food. The reason for this is that employment of a fixed reference value results in errors in the determination of the type of the food.

SUMMARY OF THE INVENTION

Therefore, an object of the present invention is to provide a heating apparatus wherein the type of the food to be heated can be reliably determined even when the initial temperature differs in one case to another.

In one aspect, the present invention provides an automatic food type determining device for a heating apparatus comprising a heating chamber having a door, heating means for heating food contained in the heating chamber and control means for controlling a heating operation of the heating means, the device comprising a temperature sensor connected to the control means and sensing a temperature in the heating chamber before the substantial heating operation of the heating means is initiated, a gas sensor connected to the control means and sensing a volume of gas in the heating chamber, gas volume change rate calculating means provided in the control means for calculating a change rate of the gas volume on the basis of output of the gas sensor, means provided in the control means for storing data of a reference value with respect to the change rate of the gas volume, the reference value being capable of being varied, means provided in the control means for varying the reference value in accordance with the sensed temperature in response to a signal generated by the temperature sensor, and determining means provided in the control means for comparing the change rate of the gas volume calculated by the gas volume change rate calculating means with the varied reference value, thereby distinguishing an alcoholic content of the food.

In the above-described arrangement, the gas volume change rate can be accurately determined even when the generation rate of the gas varies depending upon the temperature in the heating chamber since the reference value is based on the output of the temperature sensor. Consequently, the type of the food to be cooked can be reliably determined.

The gas volume change rate calculating means preferably detects a minimum value of the gas volume on the basis of the output of the gas sensor while the door of the heating chamber is open and detects a maximum value of the gas volume on the basis of the output of the gas sensor while the door is closed, and the gas volume change rate calculating means obtains the change rate of the gas volume from the detected minimum and maximum values of the gas volume. In this case, it is also preferable that the gas volume change rate calculating means calculate the change rate of the gas volume a predetermined time period after start of a heating operation.

In another aspect, the invention provides an automatic food type determining device for a heating apparatus comprising a heating chamber having a door, heating means for heating food contained in the heating chamber and control means for controlling a heating operation of the heating means, the device comprising a temperature sensor connected to the control means and sensing a temperature in the heating chamber before the substantial heating operation of the heating chamber, a steam sensor connected to the control means for sensing a content of steam in the heating chamber, steam-removed gas volume change rate calculating means provided in the control circuit for calculating a change rate of volume of the gas in which a steam component is removed from a gas component, on the basis of output of each of the gas sensor and the steam sensor, means provided in the control means for storing data of a reference value with respect to the change rate of the steam-removed gas volume, the reference value being capable of being varied, means provided in the control means for varying the reference value in accordance with the sensed temperature in response to a signal generated by the temperature sensor, and determining means provided in the control means for comparing the change rate of the steam-removed gas volume calculated by the steam-removed gas volume change rate calculating means with the varied reference value, thereby distinguishing an alcoholic content of the food.

In the above-described arrangement, the change rate of the volume of gas in which the steam component is removed is calculated and then, the obtained change rate is compared with the reference value Consequently, the accuracy in the determination of the type Of food can be further improved.

The steam-removed gas volume change rate calculating means preferably comprises gas volume change rate calculating means for calculating a change rate of the gas volume on the basis of the output of the gas sensor, steam content change rate calculating means for calculating a change rate of the steam content on the basis of the output of the steam sensor, and operational means for calculating the change rate of the steam removed gas volume by subtracting the calculated steam content change rate from the calculated gas volume change rate. In this arrangement, the gas volume change rate calculating means preferably detects a minimum value of the gas volume on the basis of the output of the gas sensor while the door of the heating chamber is open and detects a maximum value of the gas volume on the basis of the output of the gas sensor while the door is closed, and the gas volume change rate calculating means obtains the change rate of the gas volume from the detected minimum and maximum values of the gas volume. Furthermore, the steam content change rate calculating means preferably detects a minimum value of the steam content on the basis of the output of the steam sensor while the door of the heating chamber is open and detects a maximum value of the steam content on the basis of the output of the steam sensor while the door is closed, and the steam content change rate calculating means obtains the change rate of the steam content from the detected minimum and maximum values of the steam content. Furthermore, the gas volume change rate calculating means preferably calculates the change rate of the gas volume a predetermined time period after start of a heating operation and the steam content change rate calculating means calculates the change rate of the steam content a predetermined time period after start of the heating operation.

Preferably, the gas sensor is sensitive to a gaseous alcohol. Additionally, the reference value setting means is preferably provided with a reference temperature to compare the output of the temperature sensor with the reference temperature, thereby setting the reference value.

Other objects of the present invention will become obvious upon understanding of the illustrative embodiment about to be described. Various advantages not referred to herein will occur to those skilled in the art upon employment of the invention in practice.

BRIEF DESCRIPTION OF THE DRAWINGS

An embodiment of the invention will be described with reference to the accompanying drawings, in which:

FIGS. 5 (*a*) and 5 (*b*) are graphs showing the change rates of the gas volume of various foods when an initial temperature in the heating chamber is below 100° C.

DESCRIPTION OF THE PREFERRED EMBODIMENTS

Figure 2:
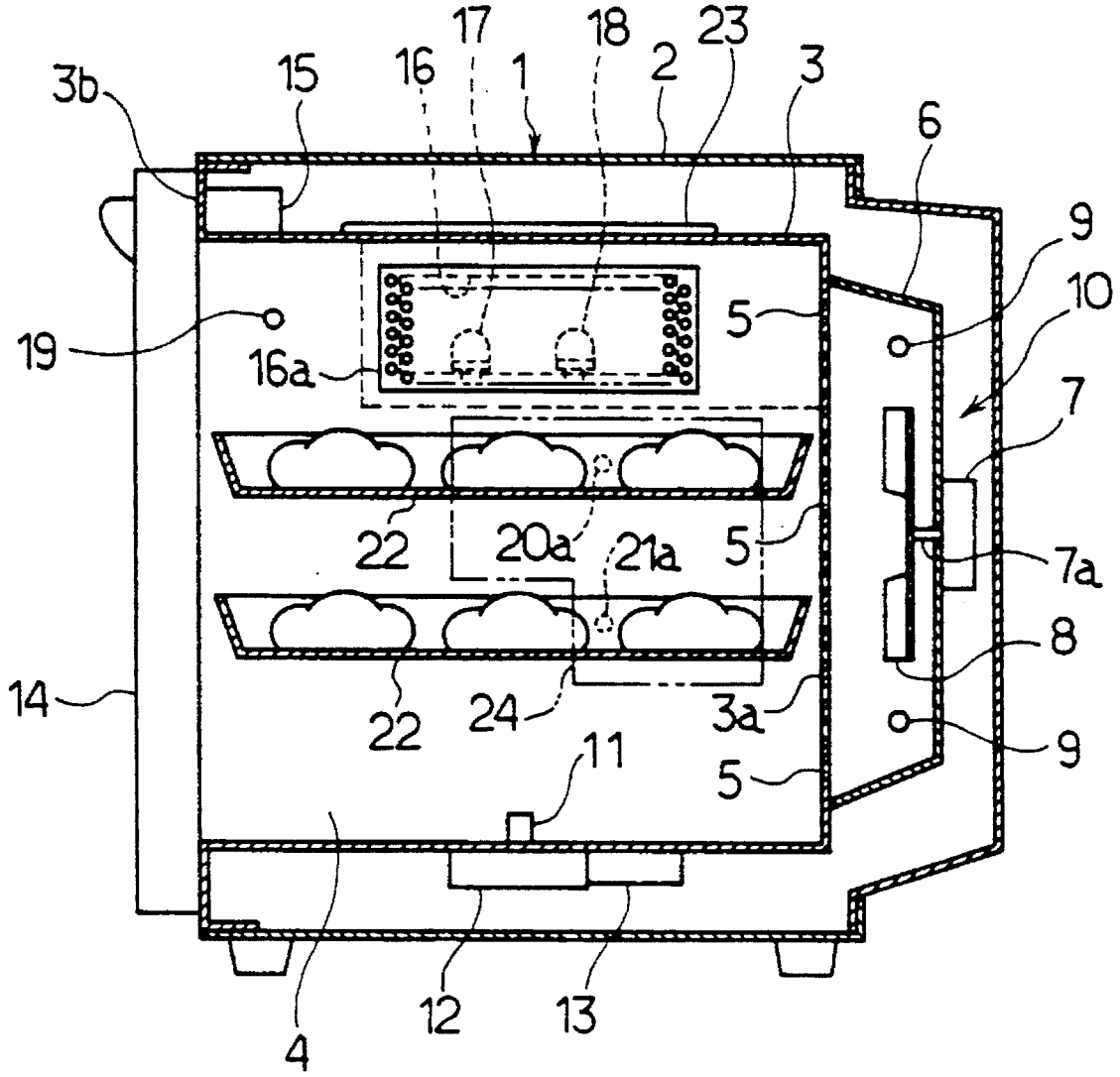
FIG. 2 is a longitudinally sectional view of the microwave oven.

The embodiment of the invention will now be described with reference to the accompanying drawings. In the embodiment, the invention is applied to a microwave oven. Referring to FIG. 2, a body 1 of the microwave oven comprises an outer casing 2 and an inner casing 3 enclosed in the outer casing 2. A heating chamber 4 is defined in the inner casing 3. A number of vent holes 5 are formed in a rear wall 3*a* of the inner casing 3. A casing 6 is mounted on the backside of the rear wall 3a and a fan motor 7 is mounted on the rear wall of the casing 6. The fan motor 7 has a rotational shaft 7*a* extending into the interior of the casing 6 and a fan 8 is mounted on the shaft 7*a* of the fan motor 7. An oven heater 9 serving as heating means is also provided in the casing 6. The fan motor 7, the fan 8 and the oven heater 9 constitute a hot air generating device 10.

A weight sensor 12 is mounted on the underside of a bottom of the inner casing 3 for sensing the weight applied to a shaft 11 to be coupled to a turntable (not shown). A turntable motor 13 is also mounted on the underside of the inner casing bottom for driving the shaft 11. A door 14 is provided for closing and opening a front opening of the inner casing 3. A door switch 15 is provided on an upper flange 3*b* of the inner casing 3 for detecting the opening and closure of the door 14.

An exhaust vent 16 covered by a net-like vent cap 16*a* is formed in one side wall of the inner casing 3. Both of a gas sensor 17 and a steam sensor 18 are provided in an exhaust path communicating between the exhaust vent 16 and the outside. The employed gas sensor 17 is of a type that is particularly sensitive to a volatile high molecular gas such as gaseous alcohol. An output of each sensor is indicated by a voltage value. The output voltage is low as a volume of gas or a content of steam is increased.

Referring further to FIG. 2, a temperature sensor 19 is mounted on the side wall of the inner casing 3 for sensing the temperature in the heating chamber 4. Two light detecting elements 20*a* and 21*a* are also provided on the side wall of the inner casing 3. Two light emitting elements 20*b* and 21*b* are provided on an opposite side wall of the inner casing 3 (not shown) so as to be disposed opposite the respective light detecting elements 20*a*, 21*a*. These pairs of light emitting and detecting elements each constitute photo sensors for sensing presence and absence of shelves 22 detachably mounted in the heating chamber 4 in the cooking. A grill heater 23 serving as another heating means is provided on the upper face of the inner casing 3. A magnetron 24 is provided in the outer casing 2 for high frequency heating.

Figure 1:
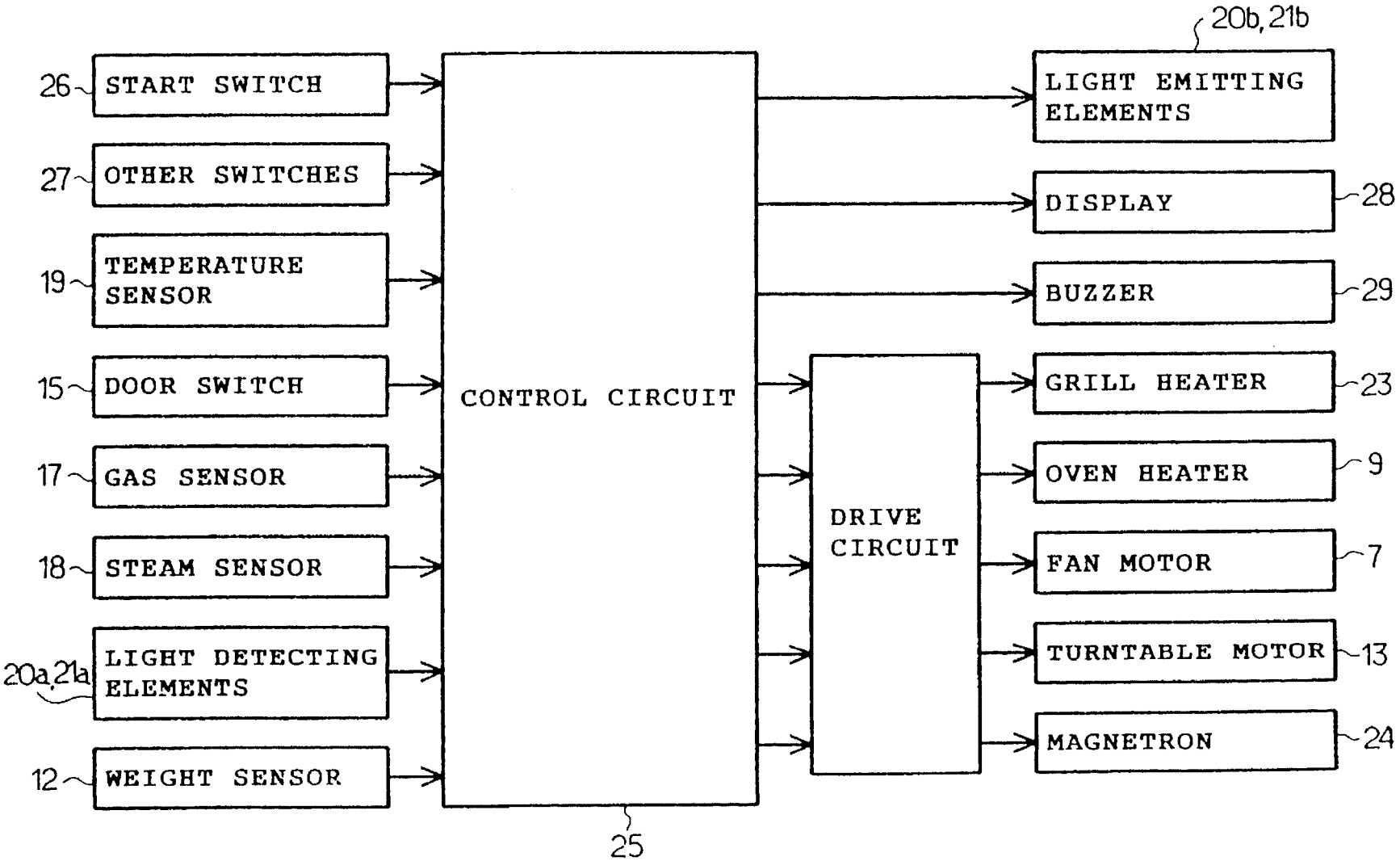
FIG. 1 is a block diagram showing an electrical arrangement of the microwave oven of the embodiment in accordance with the invention.

Referring to FIG. 1, an electrical arrangement of the microwave oven will now be described. A control circuit 25 includes a microcomputer and an analog-to-digital (A/D) converter. The control circuit 25 is supplied with switch signals from a start switch 26 and other switches 27 and output of each of the weight sensor 12, the door switch 15, the gas sensor 17, the steam sensor 18 and the light detecting elements 20*a*, 21*a*. Based on the above-described input and a control program, the control circuit 25 controls the oven heater 9, the fan motor 7, the turntable motor 13, the grill heater 23 and the magnetron 24. The control circuit 25 further controls a display 28, a buzzer 29 and the light emitting elements 20*b*, 21*b*. The control circuit has software arrangements for serving as steam-removed gas volume change rate calculating means, gas volume change rate calculating means, steam content change rate calculating means, operational means, determination means, and reference value setting means, as will be described later.

Figure 3:
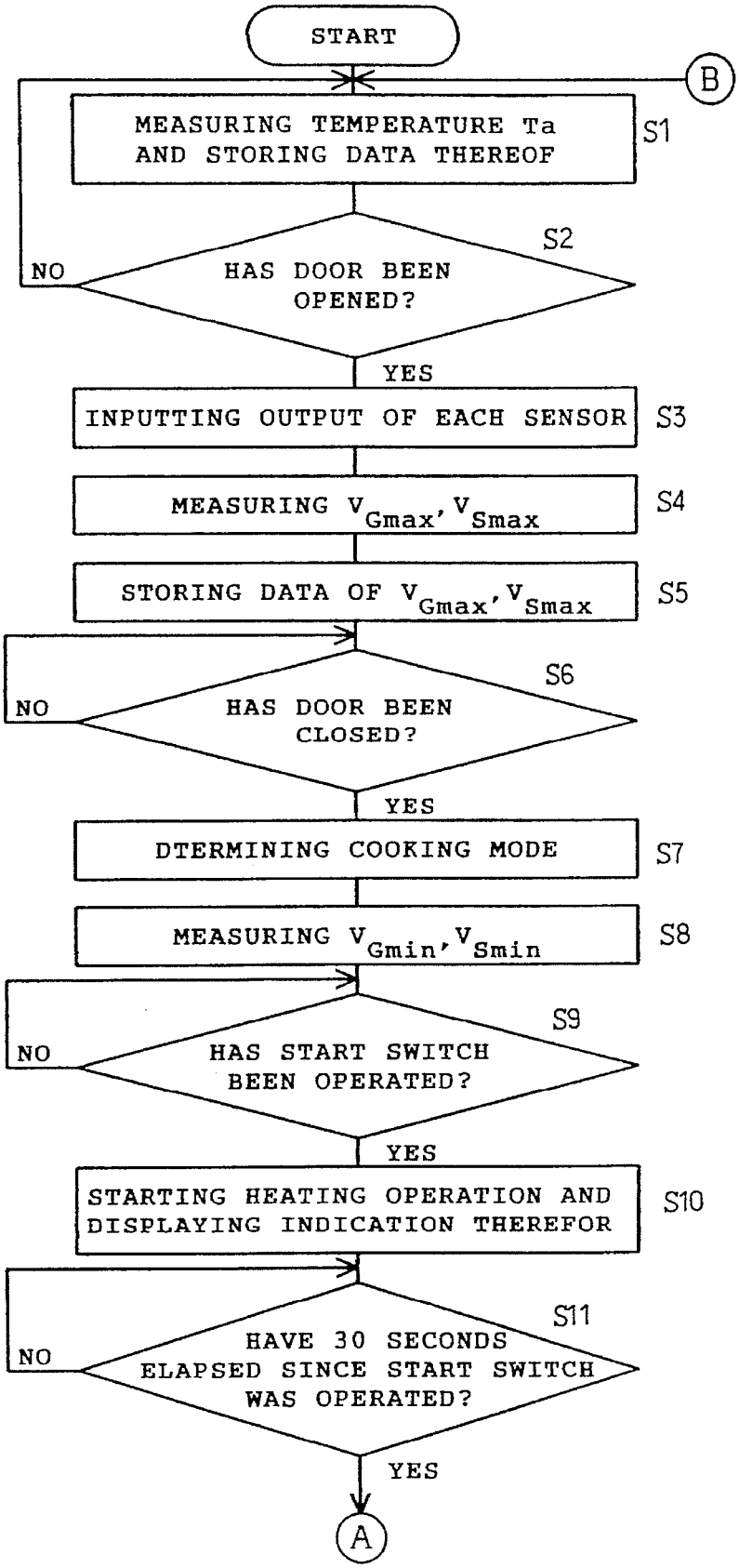
FIG. 3 is a flowchart explaining a first half of the control manner of the control circuit.
Figure 4:
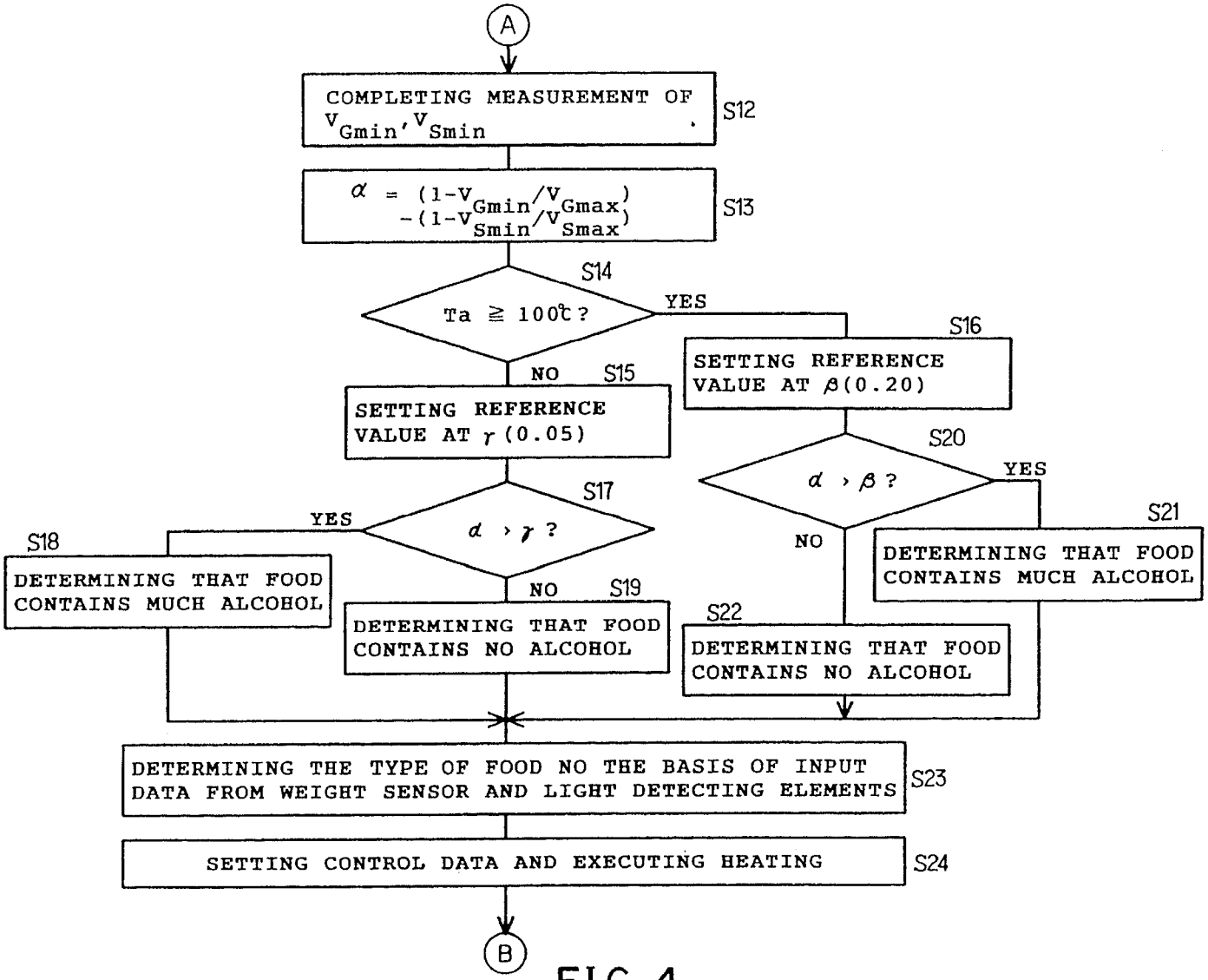
FIG. 4 is also a flowchart explaining a second half of the control manner of the control circuit.

The operation of the microwave oven will now be described with description of the functions of the control circuit 25 with reference to FIGS. 3 and 4. The flowchart of FIG. 3 starts when a power supply plug (not shown) of the microwave oven is connected to a power supply receptacle (not shown). The temperature in the heating chamber 4 is measured on the basis of the output of the temperature sensor 19 at intervals of a predetermined period of time. Data of the measured temperature values $T_a$ are sequentially stored and renewed (step S1). It is then determined on the basis of the switch signal from the door switch 15 whether the door 14 has been opened or not (step S2). When determining that the door 14 has been opened, the microcomputer-based control circuit 25 inputs the output of each of the gas and steam sensors 17, 18 (step S3) to calculate a maximum output value $V_{Gmax}$ of the gas sensor 17, which maximum output value is representative of a minimum volume of gas. The control circuit 25 further calculates a maximum output value $V_{Smax}$ of the steam sensor 18, which maximum output value is representative of a minimum content of steam (step S4). Data of these maximum values $V_{Gmax}$ and $V_{Smax}$ are stored in the microcomputer of the control circuit 25 (step S5). The above-described calculation and storing of the maximum values $V_{Gmax}$ and $V_{Smax}$ are sequentially executed until the door 14 is closed.

Upon closure of the door 14, the control circuit 25 determines a cooking mode on the basis of the output of the light detecting elements 20*a*, 21*a*, the weight sensor 12 and the like (step S7). More specifically, the control circuit 25 determines which one should be executed, an oven mode by the hot air generating device 10, a grill mode by the grill heater 23, or a high frequency mode by the magnetron 24.

Then, the control circuit 25 calculates a minimum output value $V_{Gmin}$ of the gas sensor 17, which minimum output value is representative of a maximum volume of gas. The control circuit 25 further calculates a minimum output value $V_{Smin}$ of the steam sensor 18, which minimum output value is representative of a maximum content of steam (step S8). Upon operation of the start switch 26 (step S9), a heating operation is initiated for the cooking mode determined at step S7 and an indication of "IN PROCESS 0F COOKING" is displayed on the display 28 (step S10).

The calculation of the minimum output value $V_{Gmin}$ of the gas sensor 17 and of the minimum output value $V_{Smin}$ is completed upon lapse of a predetermined time period or 30 seconds, for example, after operation of the start switch 26 (step S12).

A change rate α of the steam-removed gas volume is calculated at step S13. The steam-removed gas volume change rate α is obtained from the following equation:

$$\alpha=(1-V_{Gmin}/V_{Gmax})-(1-V_{Smin}/V_{Smin}V_{Smax}).$$

More specifically, the output of the gas sensor 17 contains a slight steam component though it mainly detects an alcoholic component. Accordingly, the gas volume change rate obtained by the term, $(1V_{Gmin}/V_{Gmax})$, contains the steam component. The steam-removed gas volume change rate can be obtained by subtracting the steam content change rate from the gas volume change rate. The steam content change rate is obtained by the term, $(1-V_{Smin}/V_{Smax})$. Consequently, the steam-removed gas volume change rate α represents a substantially correct change rate of volume of gaseous alcohol.

Thereafter, it is determined at step S14 whether or not the temperature $T_a$ detected at step S1 is at a predetermined value (100° C., for example) or above. When the temperature $T_a$ is below 100° C., a reference value is set at γ which is 0.05 in the embodiment (step S15). When the temperature $T_a$ is at 100° C. or above, the reference value is set at β which is 0.20 in the embodiment (step S16).

It is determined at step S17 whether or not the steam-removed gas change rate α is larger than γ, after execution of step S15, when the temperature $T_a$ is below 100° C. When the change rate α is larger than γ, it is determined at step S18 that the food to be cooked contains a relatively large quantity of alcohol, for example, broiled pork, pound cake, buttered roll or apple pie. When the change rate α is at γ or below, it is determined at step S19 that the food to be cooked contains a less quantity of alcohol, for example, cream puff, roast beef, cake roll, risotto, madeleine, roast chicken, or sponge cake (step S19).

When the temperature $T_a$ is at 100° C. or above at step S14, it is determined at step S20 whether or not the steam-removed gas volume change rate α is larger than β, after execution of step S16. When the change rate α is larger than β, it is determined at step S21 that the food to be cooked contains a relatively large quantity of alcohol, for example, broiled pork, pound cake, buttered roll or apple pie. When the change rate α is at β or below, it is determined at step S19 that the food to be cooked contains a less quantity of alcohol, such as cream puff, roast beef, cake roll, risotto, madeleine, roast chicken, or sponge cake (step S22).

Thus, the reference value γ or β is set in accordance with the detected temperature $T_a$ so that the type of the food to be cooked is determined. More specifically, a generation rate of gas of the food varies depending upon the initial temperature in the heating chamber and the gas volume change rate varies accordingly. As shown in FIGS. 5(*a*) and 5(*b*), the steam-removed gas volume change rate α is below 0.05 in each of the cream puff, roast beef, cake roll, risotto, madeleine, roast chicken, and sponge cake when the temperature $T_a$ is below 100° C. (25° C., for example) or when there is a relatively long time period of disuse of the apparatus between the last use and the current use. On the other hand, the change rate α exceeds 0.05 in each of the broiled pork, pound cake, buttered roll and apple pie.

Figure 6:
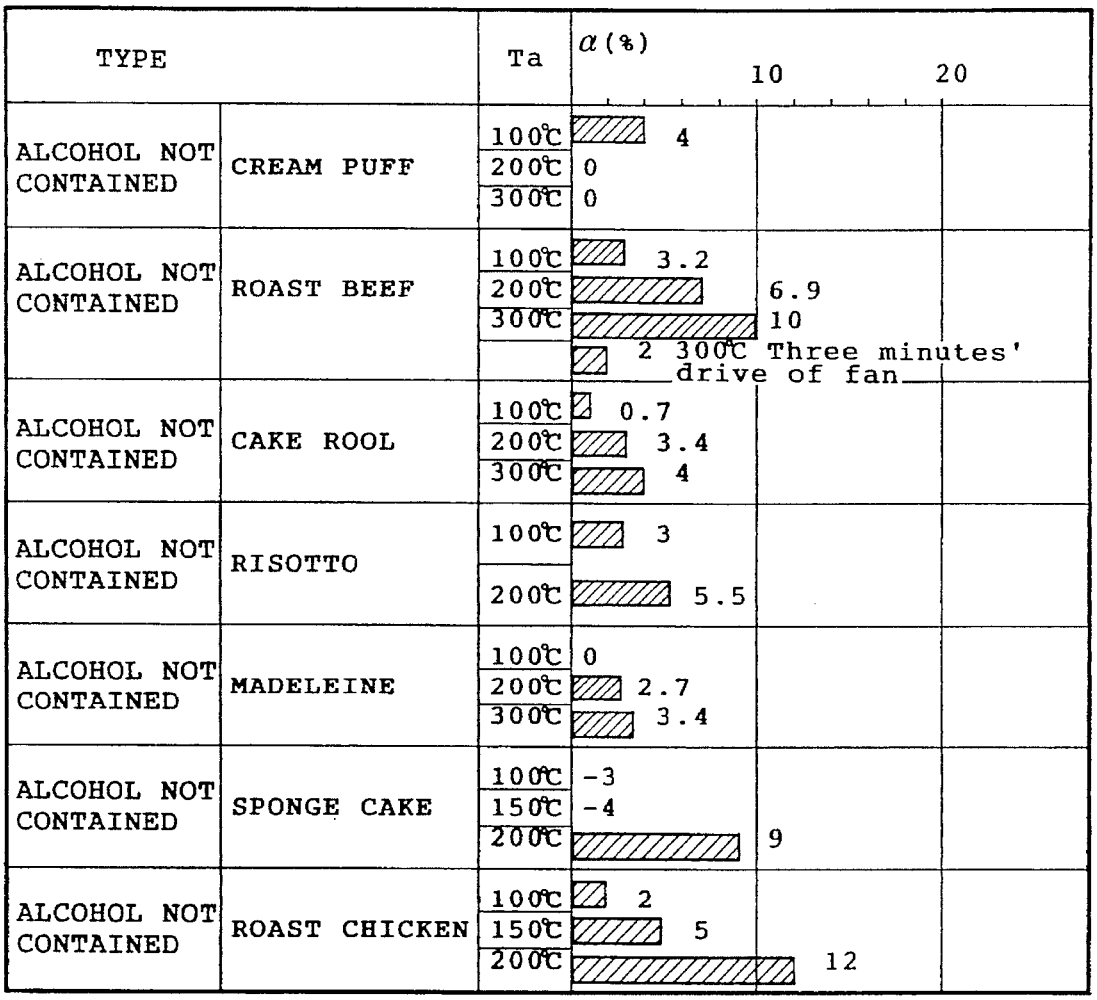
FIGS. 6(*a*) and 6(*b*) are graphs showing the change rates of the gas volume of various foods when an initial temperature in the heating chamber is at 100° C. or above.
Figure 6:
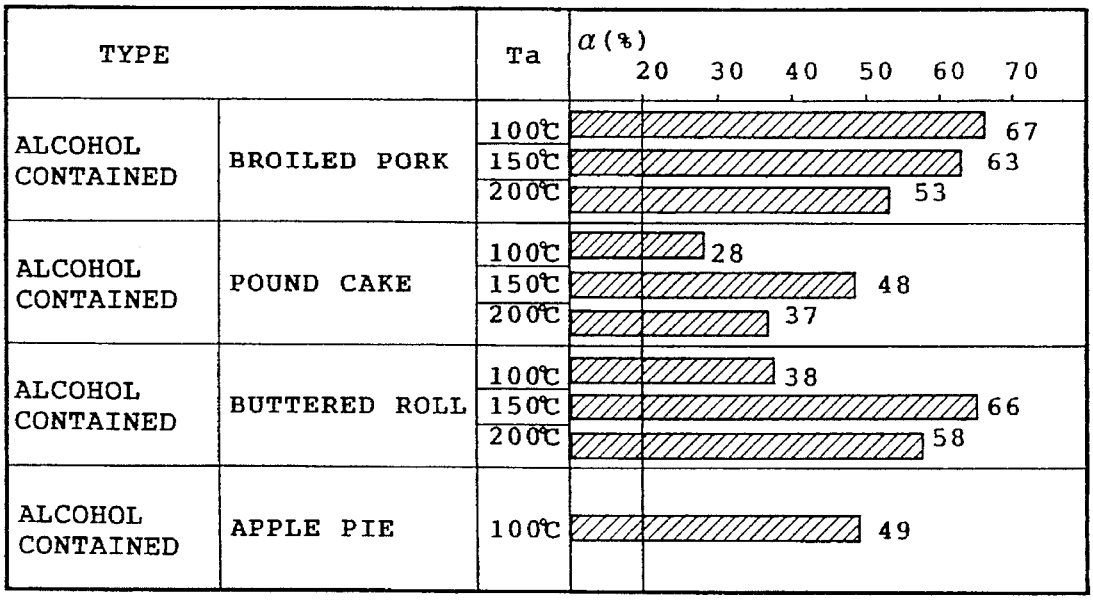

As shown in FIGS. 6(*a*) and 6(*b*), the steam-removed gas volume change rate α is below 0.20 in each of the cream puff, roast beef, cake roll, risotto, madeleine, roast chicken, and sponge cake when the temperature $T_a$ is at 100° C. or above or when the cooking operation is repeatedly executed. On the other hand, the change rate α exceeds 0.20 in each of the broiled pork, pound cake, buttered roll and apple pie.

The microcomputer-based control circuit 25 advances to step S23 after execution of steps S18, S19 and S21 or S22. Based on the results of the above-described determination and input data from the weight sensor 12 and the light detecting elements 20*a*, 21*a*, the control circuit 25 determines at step S23 more strictly about the type of the food to be cooked. The control data about a cooking temperature, a cooking time period and the like is set in accordance with the results of the determination so that the heating is executed for the food to be cooked (step S24).

According to the above-described embodiment, the temperature sensor 19 is provided for sensing the temperature in the heating chamber 4. The reference value is set in accordance with the sensed temperature. Consequently, the steam-removed gas volume change rate can be determined on the basis of the reference value in accordance with the initial temperature in the heating chamber 4. Accordingly, the type of the food to be cooked can be reliably determined even when the initial temperature in the heating chamber 4 varies.

In particular, the change rate of the alcoholic component can be accurately detected since the steam component is removed from the gaseous component.

Furthermore, the minimum volume of gas is detected on the basis of the output of the gas sensor 17 in the condition that the door 14 is opened, that is, in the condition that there is little gas in the heating chamber 4. Thus, the minimum volume of gas can be accurately detected. Furthermore, the maximum volume of gas is detected on the basis of the output of the gas sensor 17 in the condition that the door 14 is closed, that is, in the condition that the heating chamber 14 is filled with the gas. Thus, the maximum volume of gas can also be accurately detected. Consequently, the change rate of the gas volume can be reliably calculated. Additionally, the change rate of the steam content can also be reliably calculated since the minimum and maximum volumes of steam are detected in the same manner as described above.

Although the volume of gas is sequentially detected for obtaining data for the calculation of its change rate for 30 seconds starting from the start of the heating operation in the foregoing embodiment, the detecting period of time should not be limited to this. Additionally, the initial temperature in the heating chamber may be detected before the start of the heating operation.

Although both of the gas sensor 17 and the steam sensor 18 are provided for obtaining the change rate of the steam-removed gas volume in the foregoing embodiment, the change rate of the gas volume may be based only on the output of the gas sensor and the type of the food to be cooked may be determined by comparison of the obtained gas volume change rate with the reference value. In this case, the steam sensor is not necessitated, and only the gas volume change rate is calculated at step S13. The subsequent steps are executed on the basis of the obtained gas volume change rate in the same manner as described above.

The foregoing disclosure and drawings are merely illustrative of the principles of the present invention and are not to be interpreted in a limiting sense. The only limitation is to be determined from the scope of the appended claims.

I claim:

1. A heating apparatus comprising:

a) a heating chamber having a door;

b) heating means for heating food contained in the heating chamber;

c) control means for controlling a heating operation of the heating means;

d) a temperature sensor connected to the control means and sending a temperature in the heating chamber before the substantial heating operation of the heating means is initiated;

e) a gas sensor connected to the control means and sensing a volume of gas in the heating chamber;

f) gas volume change rate calculating means provided in the control means for calculating a change rate of the gas volume on the basis of output of the gas sensor;

g) means provided in the control means for storing data of a reference value with respect to the change rate of the gas volume, the reference value being capable of being varied;

h) means provided in the control means for varying the reference value in accordance with the sensed temperature in response to a signal generated by the temperature sensor; and i) determining means provided in the control means for comparing the change rate of the gas volume calculated by the gas volume change rate calculating means with the varied reference value, thereby distinguishing an alcoholic content of the food.

2. A heating apparatus according to claim 1, wherein the gas volume change rate calculating means detects a minimum value of the gas volume on the basis of the output of the gas sensor while the door of the heating chamber is open and detects a maximum value of the gas volume on the basis of the output of the gas sensor while the door is closed, and the gas volume change rate calculating means obtains the change rate of the gas volume from the detected minimum and maximum values of the gas volume.

3. A heating apparatus according to claim 2, wherein the gas volume change rate calculating means calculates the change rate of the gas volume a predetermined time period after start of a heating operation.

4. A heating apparatus according to claim 1, wherein the gas sensor is sensitive to a gaseous alcohol.

5. A heating apparatus according to claim 1, wherein the reference value setting means is provided with a reference temperature to compare the output of the temperature sensor with the reference temperature, thereby setting the reference value.

6. A heating apparatus comprising:

a) a heating chamber having a door;

b) heating means for heating food contained in the heating chamber;

c) control means for controlling a heating operation of the heating means;

d) a temperature sensor connected to the control means and sensing a temperature in the heating chamber before the substantial heating operation of the heating means is initiated;

e) a gas sensor connected to the control means and sensing a volume of gas in the heating chamber;

f) a steam sensor connected to the control means for sensing a content of steam in the heating chamber;

g) steam-removed gas volume change rate calculating means provided in the control circuit for calculating a change rate of volume of the gas in which a steam component is removed from a gas component, on the basis of output of each of the gas sensor and the steam sensor;

h) means provided in the control means for storing data of a reference value with respect to the change rate of the steam-removed gas volume, the reference value being capable of being varied;

i) means provided in the control means for varying the reference value in accordance with the sensed temperature in response to a signal generated by the temperature sensor; and j) determining means provided in the control means for comparing the change rate of the steam-removed gas volume calculated by the steam-removed gas volume change rate calculating means with the varied reference value, thereby distinguishing an alcoholic content of the food.

7. A heating apparatus according to claim 6, wherein the steam-removed gas volume change rate calculating means comprises gas volume change rate calculating means for calculating a change rate of the gas volume on the basis of the output of the gas sensor, steam content change rate calculating means for calculating a change rate of the steam content on the basis of the output of the steam sensor, and operational means for calculating the change rate of the steam removed gas volume by subtracting the calculated steam content change rate from the calculated gas volume change rate.

8. A heating apparatus according to claim 7, wherein the gas volume change rate calculating means detects a minimum value of the gas volume on the basis of the output of the gas sensor while the door of the heating chamber is open and detects a maximum value of the gas volume on the basis of the output of the gas sensor while the door is closed, and the gas volume change rate calculating means obtains the change rate of the gas volume from the detected minimum and maximum values of the gas volume, and wherein the steam content change rate calculating means detects a minimum value of the steam content on the basis of the output of the steam sensor while the door of the heating chamber is open and detects a maximum value of the steam content on the basis of the output of the steam sensor while the door is closed, and the steam content change rate calculating means obtains the change rate of the steam content from the detected minimum and maximum values of the steam content.

9. A heating apparatus according to claim 8, wherein the gas volume change rate calculating means calculates the change rate of the gas volume a predetermined time period after start of a heating operation and the steam content change rate calculating means calculates the change rate of the steam content a predetermined time period after start of the heating operation.

10. A heating apparatus according to claim 6, wherein the gas sensor is sensitive to a gaseous alcohol.

11. A heating apparatus according to claim 6, wherein the reference value setting means is provided with a reference temperature to compare the output of the temperature sensor with the reference temperature, thereby setting the reference value.

* * * * *